US009375740B2

(12) United States Patent
Jung

(10) Patent No.: US 9,375,740 B2
(45) Date of Patent: Jun. 28, 2016

(54) DISPENSER PUMP BUTTON

(75) Inventor: Seo-Hui Jung, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 14/131,674

(22) PCT Filed: Jun. 27, 2012

(86) PCT No.: PCT/KR2012/005058
§ 371 (c)(1),
(2), (4) Date: Jan. 8, 2014

(87) PCT Pub. No.: WO2013/009017
PCT Pub. Date: Jan. 17, 2013

(65) Prior Publication Data

US 2014/0144945 A1 May 29, 2014

(30) Foreign Application Priority Data

Jul. 8, 2011 (KR) ..... 10-2011-0067778

(51) Int. Cl.
*B05B 11/00* (2006.01)

(52) U.S. Cl.
CPC ..... *B05B 11/3052* (2013.01); *B05B 11/0032* (2013.01); *B05B 11/0048* (2013.01); *B05B 11/3023* (2013.01); *B05B 11/3047* (2013.01); *B05B 11/3053* (2013.01); *B05B 11/3074* (2013.01)

(58) Field of Classification Search
CPC ..... B65D 83/0044; B65D 83/0005; B65D 83/62; B05B 11/3001; B05B 11/3057; B05B 11/3015; B05B 11/3052; B05B 11/0032; B05B 11/0048; B05B 11/3023; B05B 11/3047; B05B 11/3053; B05B 11/3074; F16N 3/08; F16N 3/12
USPC ..... 222/320, 321.1, 321.3, 321.7, 321.8, 222/321.9, 380, 385, 386, 386.5, 256
See application file for complete search history.

(56) References Cited

U.S. PATENT DOCUMENTS

| | | | | |
|---|---|---|---|---|
| 2005/0006411 | A1* | 1/2005 | Kuwahara et al. | 222/321.1 |
| 2009/0101677 | A1* | 4/2009 | Rossignol | 222/256 |
| 2011/0121037 | A1* | 5/2011 | Kakuta | 222/320 |

FOREIGN PATENT DOCUMENTS

| | | | | |
|---|---|---|---|---|
| KR | 10-2008-0001894 | | 1/2008 | |
| KR | 10-0814319 | | 3/2008 | |
| KR | 20-2009-0010141 | | 10/2009 | |
| KR | 20-2011-003474 | | 4/2011 | |
| KR | 2011 0003474 | * | 4/2011 | B05B 11/3052 |

* cited by examiner

*Primary Examiner* — Nicholas J Weiss
(74) *Attorney, Agent, or Firm* — Marshall, Gerstein & Borun LLP

(57) ABSTRACT

A dispenser pump button is designed so as to have a structure in which, when the button body is pressed, a nozzle which is normally positioned within the button body moves forward so as to be exposed to the outside from the button body and enable contents to be discharged, in order to prevent a cap from being contaminated.

6 Claims, 4 Drawing Sheets

DISPENSER PUMP BUTTON

BACKGROUND

The present invention relates to a dispenser pump button, and in particular to a dispenser pump button which makes it possible to prevent a cap from being contaminated, in such a way that a nozzle is normally positioned in a button body, but when the button body is pressed, the nozzle moves forward and gets exposed to the outside of the button body for thereby discharging contents.

A dispenser, in general, is engaged to the top of a sealed container filled with gas, liquid or contents and is configured to discharge a certain amount of the contents when it is pressed. The dispenser is applied to various sealed containers which store cosmetics, perfume, drugs or food. At the top of the dispenser is disposed a button with which to press the dispenser. The contents are discharged through the nozzle as the user handles the button.

At the button of the dispenser is provided a nozzle through which contents are discharged out. The inner sides of the cap of the cosmetic container may be contaminated by the left-over cosmetics which remains in the nozzle after the user used cosmetics. The cosmetic cap is equipped with a button pressing prevention function and a contamination prevention function of the cosmetics. The contaminated cap may further contaminate the cosmetics and may make the exterior of the container look bad.

In order to prevent the contamination of the cap which occurs as the nozzle is exposed to the outside, there is suggested a structure which makes it possible to discharge contents in a state that the nozzle is positioned in the button. If the contents are discharged in a state that the nozzle is positioned in the button, the cap can be prevented from being contaminated; however it is hard to discharge the contents to where the user wants. In this case, the contents may stain the button or the decorated portions in the middle of the discharge of contents, thus causing more contaminations.

SUMMARY OF THE INVENTION

Accordingly, the present invention is made in consideration of the above mentioned problems. It is an object of the present invention to provide a dispenser pump button which makes it possible to prevent a cap from being contaminated, in such a way that a nozzle is normally positioned in a button body, but when the button body is pressed, the nozzle moves forward and is exposed to the outside of the button body for thereby discharging contents.

It is another object of the present invention to provide a dispenser pump button which makes it possible to prevent contents from going spoiled, in such a way that the air does not flow in the cosmetic container when it is normally used as a discharge hole of a nozzle is closed with an opening and closing rod provided at a discharge part.

It is further another object of the present invention to provide a dispenser pump button in which a guide member performs a piston function while a button body moves upward, for thereby sucking in the contents remaining in the nozzle, by which to minimize the remaining amount of the contents in the nozzle, so the contamination of the contents can be prevented, and the problems, which occurs due to the solidification of contents at the nozzle, can be prevented.

To achieve the above objects, there is provided a dispenser pump button which is positioned at the top of a pumping member and pressurizes the pumping member when a user presses for thereby discharging contents with the aid of pumping operations, comprising a button body which includes a content flow passage formed at an inner center portion for the contents to flow and communicates with the content flow passage, and a discharge part communicating with the content flow passage for thereby discharging the contents; a nozzle which is engaged to the discharge part and discharges out the contents, and moves back and forth when the button body moves up and down and is equipped with a discharge hole at its front side for the sake of discharge of the contents, and a guide groove formed at its side for guiding the forward and backward movements; a guide member which is engaged to the inner side of the button body and is equipped with the guide groove of the nozzle and allows the nozzle to move back and forth when the button body moves up and down; and an elastic part one side of which is supported against the guide member, and the other side of which is supported against the inner side of the button body for thereby allowing the button body to move upward by providing an elastic force in an upward direction.

In addition, an opening and closing rod is provided at the button body for opening and closing the discharge hole of the nozzle, and the opening and closing rod extends from a bottom wall surface of the discharge part to the top and is vertically bent in a forward direction.

In addition, part of the bottom of the nozzle is cut away so as to prevent any interference with the opening and closing rod when it is engaged to the discharge part.

In addition, the guide member comprises a suction part engaged to the content flow passage and providing a piston function of sucking the contents which remains in the nozzle; an engaging part which is formed in a cylindrical shape extending down the suction part and is engaged to the top of the pumping member; and a spring support part which surrounds the suction part and extends from the suction part and forms a mounting part on which to mount the bottom of the elastic part.

In addition, the guide protrusion comprises a pair of protrusion pieces protruding upward from the center of the suction part, and a guide bar which connects the protrusion pieces at the end portions of the protrusion pieces and is engaged to the guide grove.

In addition, a content inflow hole is formed at the bottom of the guide protrusion for flowing in the contents which move through the engaging part.

In addition, the button body includes an extension part which surrounds the content flow passage at an outer side of the content flow passage and extends downward, and a fixing part is engaged to the extension part so as to fix the guide member to the button body and is hollow.

The present invention makes it possible to prevent a cap from being contaminated, in such a way that a nozzle is normally positioned in a button body, but when the button body is pressed, the nozzle moves forward and is exposed to the outside of the button body for thereby discharging contents.

The present invention makes it possible to prevent contents from going spoiled, in such a way that the air does not flow in the cosmetic container when it is normally used as a discharge hole of a nozzle is closed with an opening and closing rod provided at a discharge part.

In addition, the guide member has a piston function when the button body moves upward for thereby sucking in the contents remaining in the nozzle, by which to minimize the remaining amount of the contents in the nozzle, so the contamination of the contents can be prevented, and the problems, which occur due to the solidification of contents at the nozzle, can be prevented.

DETAILED DESCRIPTION OF THE INVENTION

Figure 1:
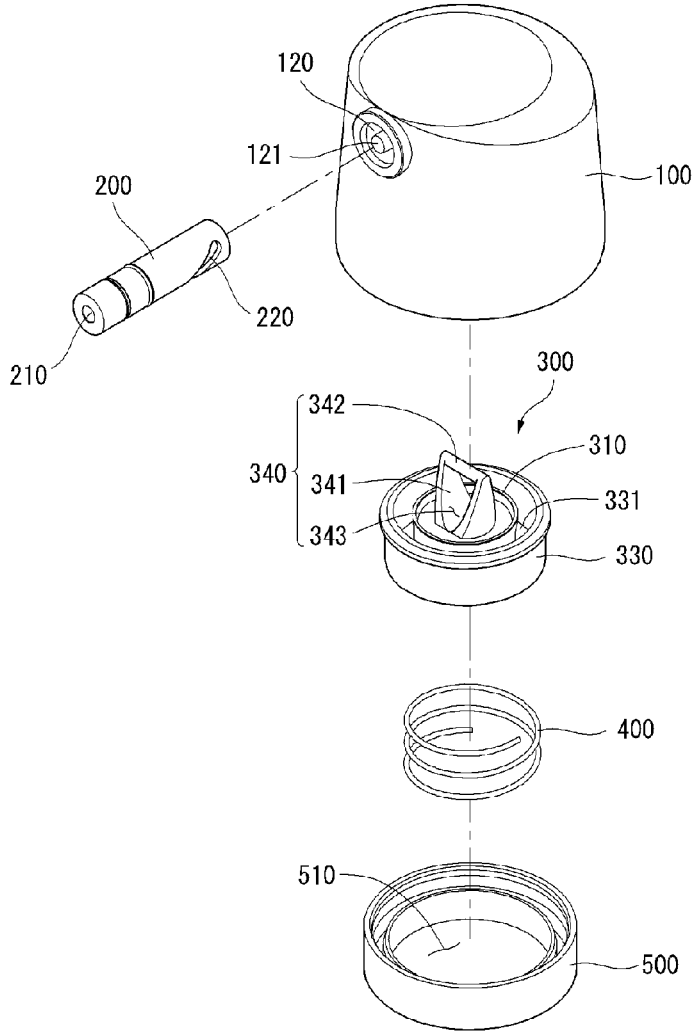
FIG. 1 is a disassembled perspective view illustrating a construction of a dispenser pump button according to a preferred embodiment of the present invention.

The present invention will be described with reference to the accompanying drawings. The same reference numerals of each drawing represent the same elements.

Figure 2:
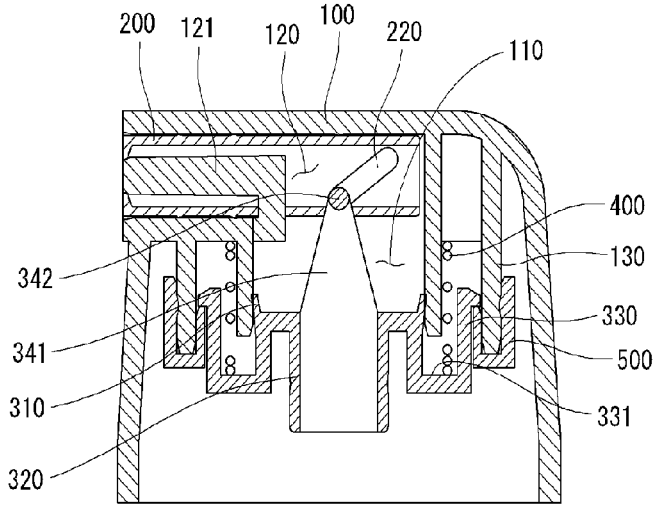
FIG. 2 is a cross sectional view illustrating a construction of a dispenser pump button according to a preferred embodiment of the present invention.
Figure 3:
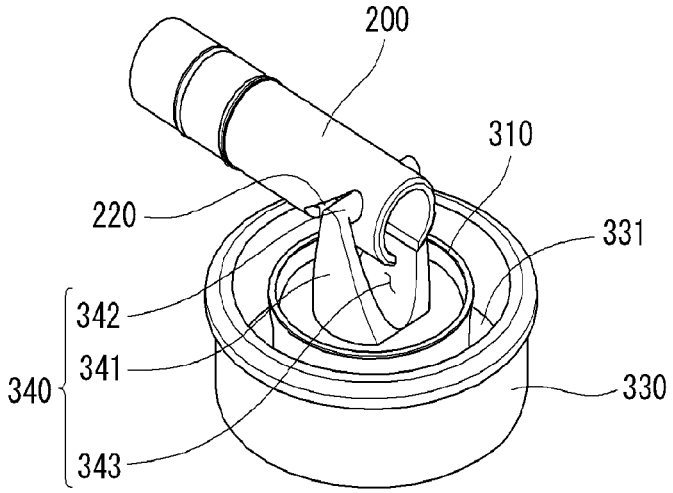
FIG. 3 is a perspective view illustrating an engaged state of a nozzle and a guide member of a dispenser pump button according to a preferred embodiment of the present invention.

FIG. 1 is a disassembled perspective view illustrating a construction of a dispenser pump button according to a preferred embodiment of the present invention. FIG. 2 is a cross sectional view illustrating a construction of a dispenser pump button according to a preferred embodiment of the present invention. FIG. 3 is a perspective view illustrating an engaged state of a nozzle and a guide member of a dispenser pump button according to a preferred embodiment of the present invention.

Figure 4:
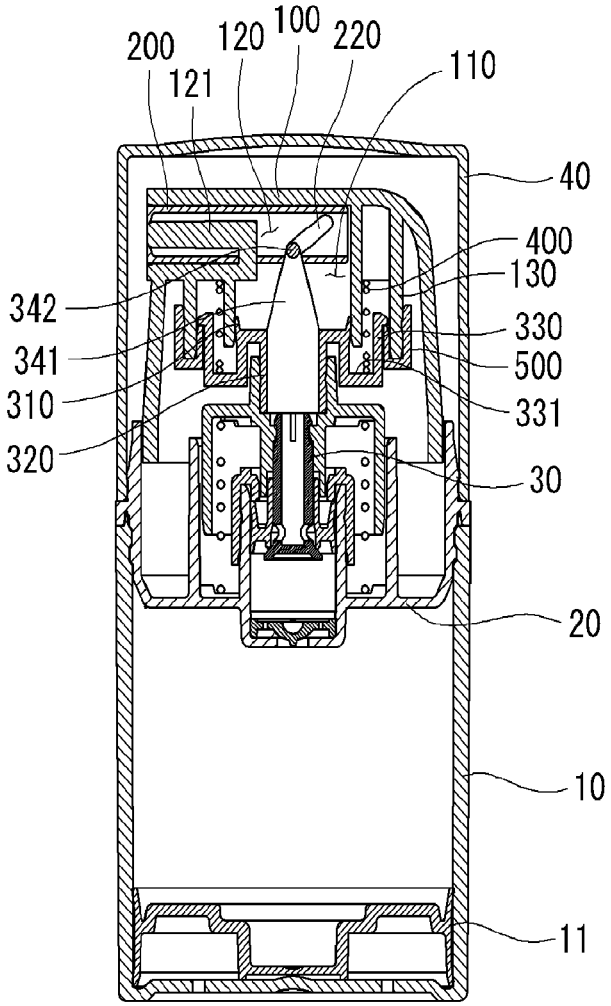
FIG. 4 is a cross sectional view illustrating a state that a dispenser pump button is engaged to a container body according to a preferred embodiment of the present invention.
Figure 5:
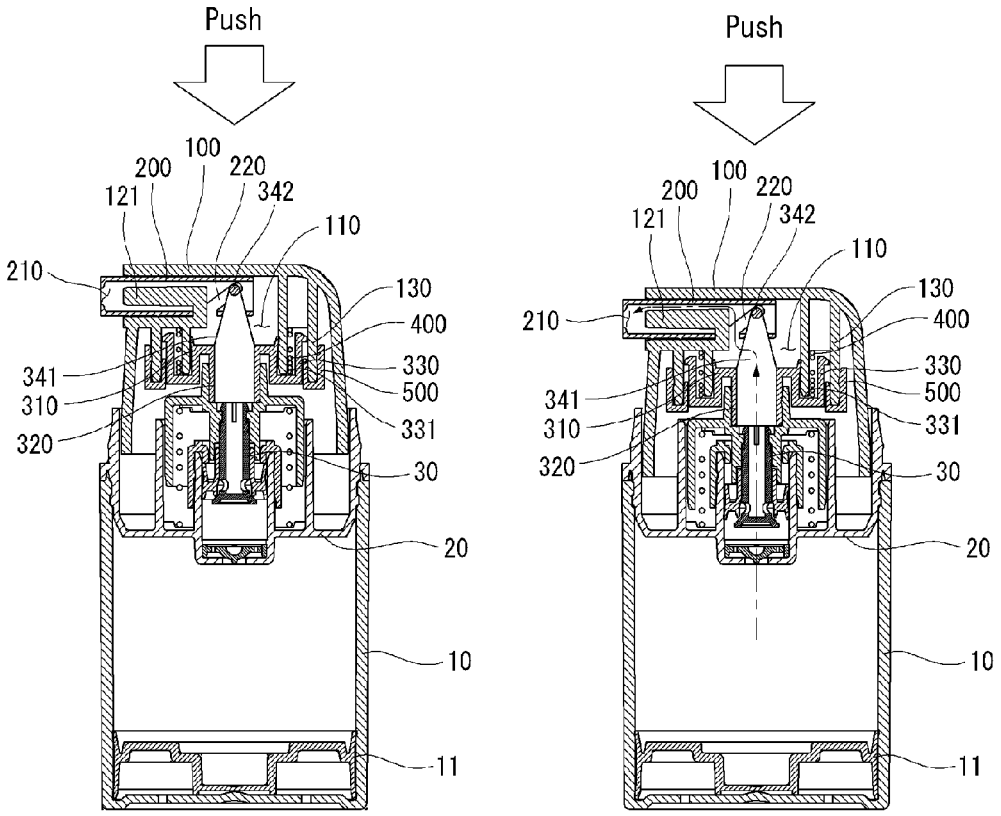
FIGS. 5 and 6 are views illustrating the operation states of a dispenser pump button according to a preferred embodiment of the present invention.
Figure 6:
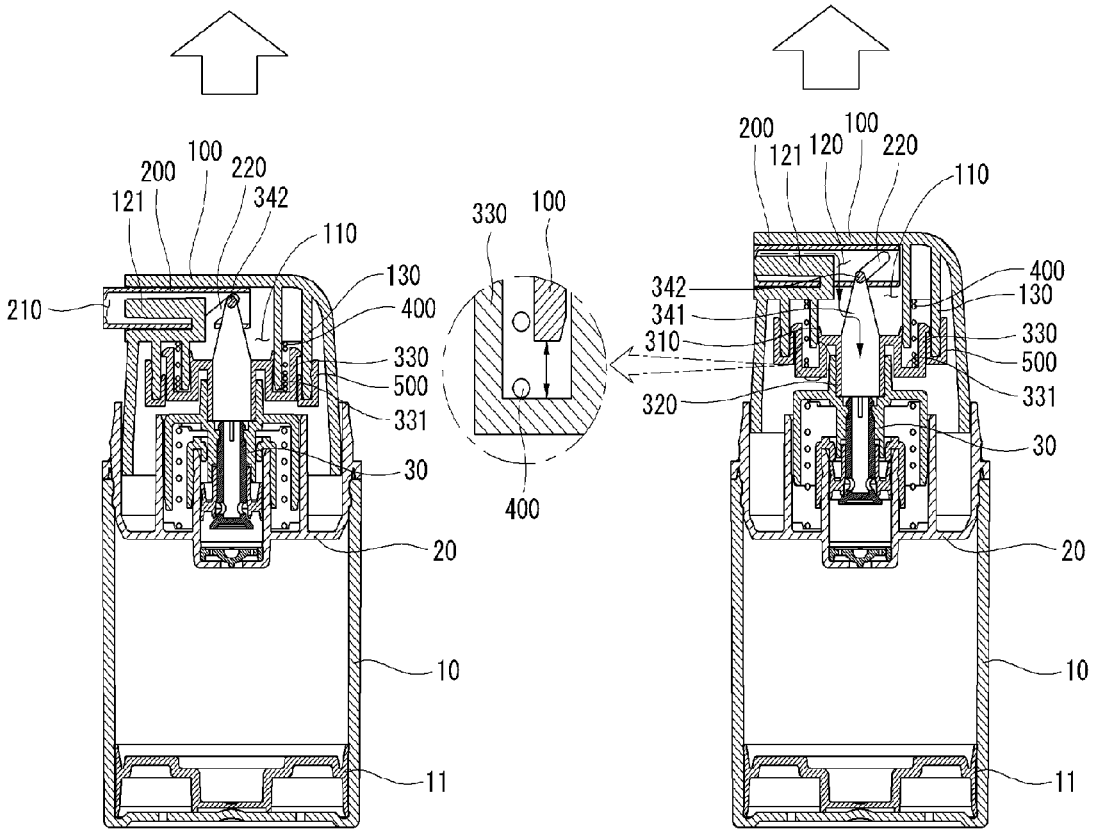

FIG. 4 is a cross sectional view illustrating a state that a dispenser pump button is engaged to a container body according to a preferred embodiment of the present invention. FIGS. 5 and 6 are views illustrating the operation states of a dispenser pump button according to a preferred embodiment of the present invention.

The present invention is directed to a dispenser pump button which is disposed at the top of a dispenser container and moves up and down when a user presses, and presses a pumping member 30. Here the typical dispenser container comprises a container body 10 which stores contents and is equipped with a piston 11 disposed at an inner lower portion and ascending and descending in the middle of the use of the content, a support part 20 which is engaged to the top of the container body 10 and supports the pumping member 30, a pumping member 30 which is engaged to the top of the support part 20 and performs a pumping operation when the button member is pressed, and an over cap 40 which surrounds the pumping member and is engaged to the top of the container body 10.

The container body 10, the support part 20, the pumping member 30 and the over cap 40 are already open to public, so the descriptions thereon will be omitted. The construction of the dispenser pump button according to the present invention will be described in details.

As shown in FIGS. 1 to 6, the dispenser pump button according to a preferred embodiment of the present invention comprises a button body 100, a nozzle 200, a guide member 300 and an elastic part 400.

The button body 100 is disposed at the top of the pumping member 30 engaged to the container body 10 and pressurizes the pumping member 30 when the user presses it for thereby discharging contents based on the pumping operations.

To the top of the container body 10 is engaged the support part 20 which supports the pumping member 30. At the inner lower end of the container body 10 is disposed a piston 11 which ascends and descends in the middle of the use of the contents.

At an inner center portion is formed a content flow passage 110 through which the contents flow. At an end portion of the content flow passage 110 is formed a discharge part 120 which communicates with the content flow passage 110 for thereby discharging contents.

The present invention has features in that at the button body 100 is provided an opening and closing rod 121 which opens and closes a discharge hole 210 of the nozzle 200. The opening and closing rod 121 extends upward from the lower wall surface of the discharge part 120 and vertically bends forward for thereby opening and closing the discharge hole 210 when the nozzle 200 moves back and forth. When the cosmetic container is not used, the discharge hole 210 of the nozzle 200 is closed so as to prevent the input of the air into the button body 100, so the spoilage of the contents can be prevented.

The opening and closing rod 121 is integrally formed at the button body 100. It is therefore possible to reduce the manufacture time which takes when separately manufacturing the opening and closing rod 121 and assembling it to the button body 100.

In the button body 100 is formed an extension part 130 which extends downward as if it surrounds the content flow passage 110 along an outer side of the content flow passage 110, and to the extension part 130 is engaged a fixing part 500 having a hollow part 510 for thereby supporting the guide member 300, so it is possible to prevent an escape of the guide member 300 from the button body 100.

The nozzle 200 is engaged to the discharge part 120 for thereby discharging out the contents and moves back and forth when the button body 100 moves up and down, and at its front part is formed a discharge hole 210 through which to discharge contents, and at its side part is formed a guide groove 220 so as to guide the forward and backward movements.

It is preferred that part of the lower end of the nozzle 200 is cut away so as to prevent any interference which may occur due to the presence of the opening and closing rod 121 when it is engaged to the discharge part 120.

The guide member 30 is engaged to an inner side of the button body 100 and allows the nozzle 200 to move back and forth when the button body 100 moves up and down and comprises a suction part 310, an engaging part 320, a spring support part 330 and a guide protrusion 340

The suction part 310 is engaged to the content flow passage 310. In the present invention, as shown in FIG. 6, the suction part 310 provides a piston function through which to suck the contents which remains in the nozzle 200 by the distance that the button body 100 moves along when the button body 100 moves upward, by means of which it is possible to reduce in maximum the amount of contaminants which remain in the nozzle 200 and are stuck to in the nozzle.

The engaging part 320 extends down the suction part 310 and is engaged to the top of the pumping member 30 and fixes the guide member 300 to the pumping member 30 and transfers the pumping member 30 a press force when the button body 100 is pressed.

It is preferred that the engaging part 320 is formed in a cylindrical shape the inner side of which is hollow so as to move the contents discharged from the pumping member 30.

The spring support part 330 surrounds the suction part 310 and extends from the suction part 310 and forms a mounting part 331 for mounting the bottom of the elastic part 400 for thereby supporting the bottom of the elastic part 400.

The guide protrusion 340 protrudes upward from the center of the suction part 310 and is engaged to the guide groove 220 and allows the nozzle 200 to move back and forth when the button body 100 moves up and down and comprises a pair of protrusion pieces 341 protruding upward from the center of the suction part 310, and a guide bar 342 which connects the protrusion pieces 341 at the end portions of the protrusion pieces 341 and is engaged to the guide grove 220.

It is preferred that a content inflow hole 343 is formed at the bottom of the guide protrusion 340 for the contents moving through the engaging part 320 to flow through the content inflow hole 343.

The elastic par 400 is positioned at the inner side of the button body 100 and contracts when the user pressurizes the button body 100 and releases when the pressurization by the user is released and provides an elastic force in an upward direction for thereby allowing the button body 100 to move upward. One side of the elastic part 400 is supported against the mounting par 331 of the guide member 300, and the other side of the same is supported against the inner side of the button body 100.

The operations of the dispenser pump body according to a preferred embodiment of the present invention will be described with reference to FIGS. 5 and 6. FIGS. 5 and 6 are views illustrating the operation states of a dispenser pump button according to a preferred embodiment of the present invention.

As shown in FIGS. 5 and 6, according to the dispenser pump button according to a preferred embodiment of the present invention, when the user pressurizes the button body 100, the button body 100 moves downward. At this time, the nozzle 200 moves forward by the guide protrusion 340 of the guide member 300, and the button body 100 gets to expose to the outside, and the discharge hole 210 which remains closed by the opening and closing rod 121 gets opened. When the button body 100 is further pressed in a state that the nozzle 200 is exposed to the outside, the engaging part 320 engaged to the pumping member 30 transfers the pressure to the pumping member 30, so the pumping member starts pumping. As a result, the contents stored in the container body 10 rises and can be finally discharged to the outside through the discharge hole 210 of the nozzle 200.

When the user releases the pressurized state of the button body 100, the elastic part 400 which remains contracted by the pressurization of the button body 100 gets to release for thereby providing an elastic force in an upward direction. At this time, the nozzle 200 moves backward by the guide protrusion 340 of the guide member 300 and is inserted into the button body 100, so the nozzle 200 hides in the interior of the button body 100. When the nozzle 200 is inserted into the interior of the button body 100, the discharge hole 210 of the nozzle 200 is closed by the opening and closing rod 121, so the air is prevented from flowing into the interior of the button body 100, whereby the spoilage of the contents can be prevented.

According to the present invention, the nozzle 20 normally remains hidden in the interior of the button body 100. When in use, the nozzle 200 gets exposed to the outside for thereby discharging contents. So, it is possible to prevent any contamination of the nozzle which used to happen as the nozzle is being exposed to the outside and to prevent any contamination for thereby improving the construction of the dispenser pump body.

The construction that the opening and closing rod 121 extends from the bottom wall surface of the discharge part 120 to the top and is vertically bent in the forward direction was described above; however it may extend downward from the top wall surface of the discharge part 120 and may be vertically bent in the forward direction. In this case, part of the end of the top of the nozzle 200 may be cut away.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

The invention claimed is:

1. A dispenser pump button which is positioned at a top of a pumping member and pressurizes the pumping member upon a user's pressing, thereby discharging contents with the aid of pumping operations, comprising:

a button body, comprising a content flow passage which is formed at an inner center portion of the button body for the contents to flow out and a discharge part which communicates with the content flow passage, for discharging the contents;

a nozzle which is engaged to the discharge part and discharges out the contents, and moves back and forth when the button body moves up and down, wherein a discharge hole is provided at a front side of the nozzle for the discharge of the contents, and a guide groove formed at a side of the nozzle for guiding the forward and backward movements;

a guide member which is engaged to an inner side of the button body, further comprising a guide protrusion which is coupled to with the guide groove of the nozzle, thereby allowing the nozzle to move back and forth when the button body moves up and down;

an elastic part comprising a first side and a second side, the first side supported against the guide member and the second side supported against the button body, thereby providing an elastic force in an upward direction and allowing the button body to move upward, and, wherein the button body further comprises an opening and closing rod which opens and closes a discharge hole of the nozzle is provided at the button body, and wherein the opening and closing rod extends from a bottom wall surface of the discharge part to a top of the discharge part and is bent with right angles toward the discharge hole.

2. The button of claim 1, wherein a bottom part of the nozzle is open so as to prevent any interference with the opening and closing rod when the nozzle is engaged to the discharge part.

3. The button of claim 1, wherein the guide member comprises:

a suction part engaged to the content flow passage and providing a piston function of sucking the content which remains in the nozzle;

an engaging part which is formed in a cylindrical shape, extends down from the suction part and is engaged to the top of the pumping member; and a spring support part which surrounds the suction part, extending from the suction part, and forms a mounting part which mounts at the bottom of the elastic part.

4. The button of claim 3, wherein the guide protrusion comprises a pair of protrusion pieces protruding upward from a center of the suction part, and a guide bar which connects the pair of protrusion pieces at the end portions of the protrusion pieces and is engaged to the guide groove.

5. The button of claim 3, wherein a content inflow hole is formed at a bottom of the guide protrusion so that the contents moving through the engagement part can flow into the discharge part.

6. The button of claim 1, wherein the button body includes an extension part which surrounds the content flow passage at an outer side of the content flow passage and extends downward, and a hollow fixing part is engaged to the extension part so as to fix the guide member to the button body.

* * * * *